United States Patent [19]

Robinson

[11] 4,129,912

[45] Dec. 19, 1978

[54] AQUATIC DEVICE

[76] Inventor: Walter L. Robinson, P.O. Box 642, Ft. Bragg, Fayetteville, N.C. 28302

[21] Appl. No.: 786,069

[22] Filed: Apr. 11, 1977

Related U.S. Application Data

[63] Continuation-in-part of Ser. No. 461,637, Apr. 17, 1974, abandoned.

[51] Int. Cl.[2] ..... A63C 15/04

[52] U.S. Cl. ..... 9/310 D; 115/24.1; 280/11.37 H

[58] Field of Search ..... 9/310 D, 310 C, 310 R, 9/310 F; 114/138, 141, 153; 115/24.1; 280/11.37 B, 11.37 D, 11.37 H; 135/71

[56] References Cited

U.S. PATENT DOCUMENTS

| | | | |
|---|---|---|---|
| 974,520 | 11/1910 | Risso | 9/310 D |
| 1,420,579 | 6/1922 | Schneidenbach | 114/138 X |
| 1,693,867 | 12/1928 | Reinwald | 9/310 D |
| 2,153,939 | 4/1939 | Schaupp | 9/310 D |
| 2,707,789 | 5/1955 | Brown | 9/310 D |
| 2,817,348 | 12/1957 | Holliday, Jr. | 135/71 |
| 2,841,805 | 7/1958 | Roudebush | 9/310 C |
| 2,893,021 | 7/1959 | Lundborg | 9/310 D X |
| 2,947,010 | 8/1960 | Rabin | 9/307 |
| 3,363,599 | 1/1968 | Hoekstra | 114/153 |
| 3,566,427 | 3/1971 | Davis et al. | 9/310 D |
| 3,750,203 | 8/1973 | Ceccato | 9/310 D |
| 3,879,048 | 4/1975 | Penney | 280/11.37 H |

FOREIGN PATENT DOCUMENTS

| | | | |
|---|---|---|---|
| 300600 | 4/1916 | Fed. Rep. of Germany | 9/310 D |
| 1373564 | 12/1964 | France | 9/310 D |

*Primary Examiner*—Trygve M. Blix
*Assistant Examiner*—Sherman D. Basinger
*Attorney, Agent, or Firm*—Stein & Frijouf

[57] ABSTRACT

An aquatic device comprising a pair of pontoon-like elements each for receiving and accommodating the operator's feet and a pair of paddles specifically configured for use in the standing position and in combination with the pontoon-like elements. The pontoon-like elements each may include a variable directional control comprising a rudder interconnected to the operator's legs by a flexible coupling and a stabilizer comprising an adjustable keel element extending downward from the lower portion of each of the pontoon-like elements. The pair of pontoon-like elements are interconnected to provide additional stabilization and coordination therebetween. Each of the paddles comprises an elongated shaft extending downwardly and terminating in a blade and an upper arm engaging rest formed at right angles thereto to permit coordinated paddling of the aquatic device. The paddles may also be used for directional control.

14 Claims, 21 Drawing Figures

FIG. 1
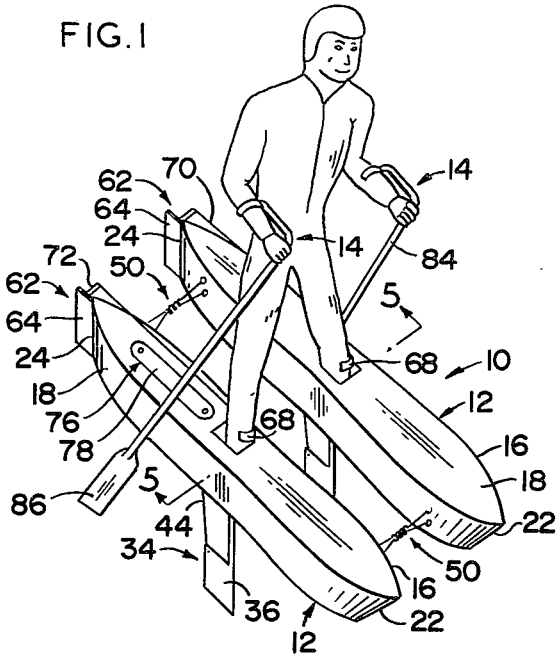
FIG. 4
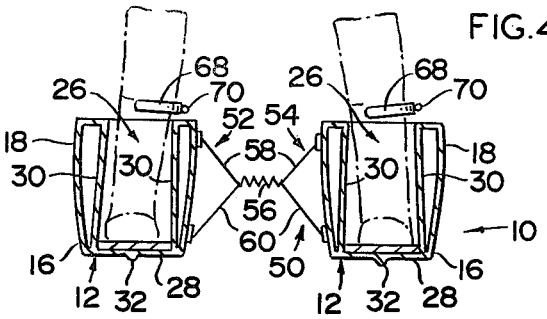
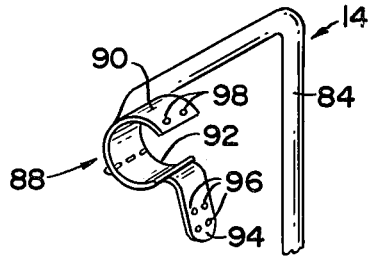
FIG. 6
FIG. 2
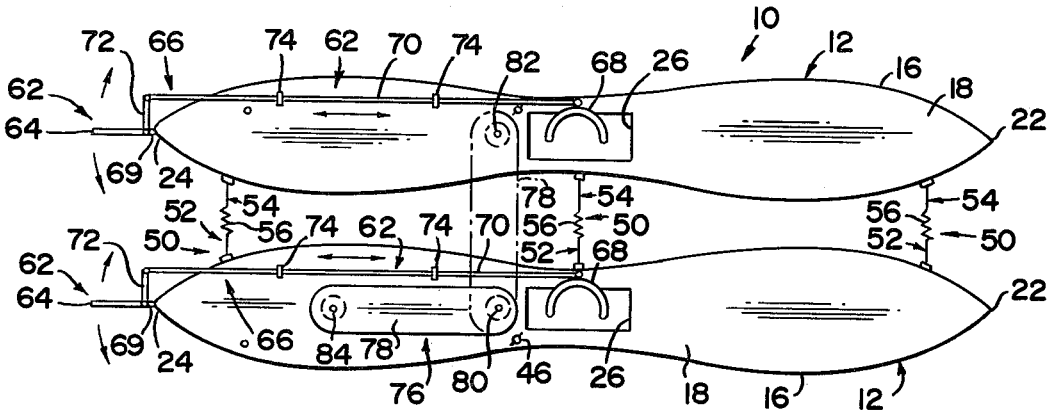
FIG. 3
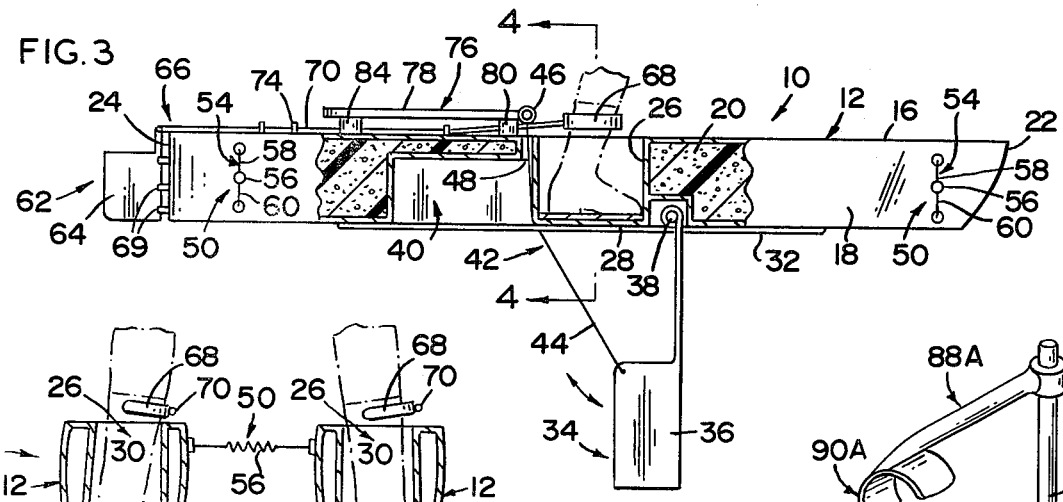
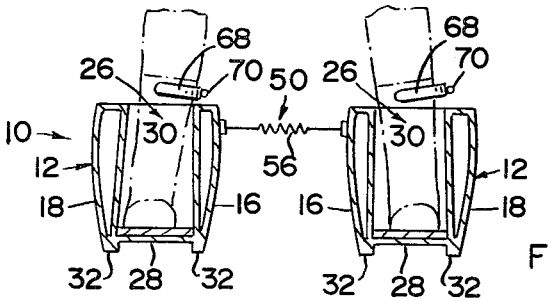
FIG. 5
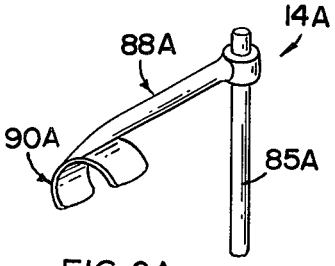
FIG. 6A FIG. 7
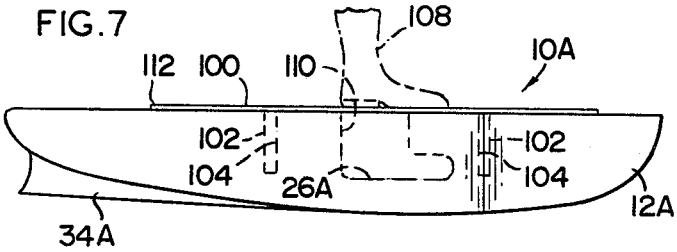
FIG. 8
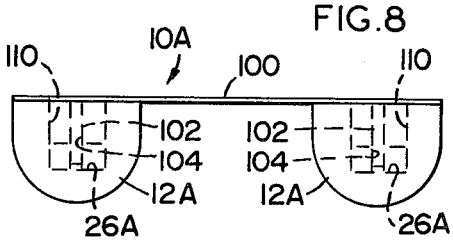
FIG. 9
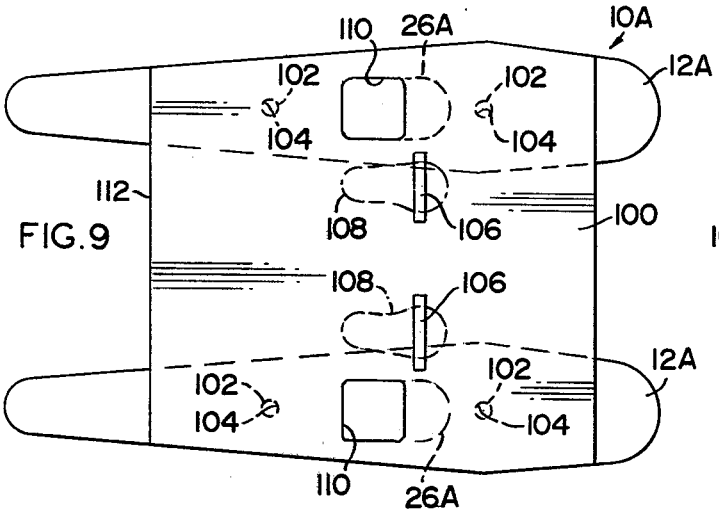
FIG. 12
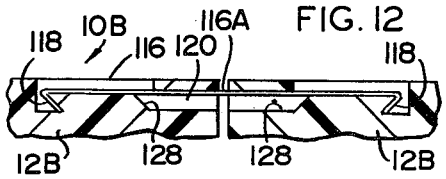
FIG. 12A
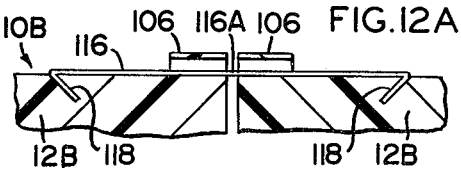
FIG. 15
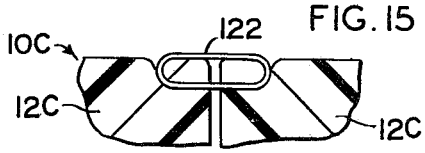
FIG. 10
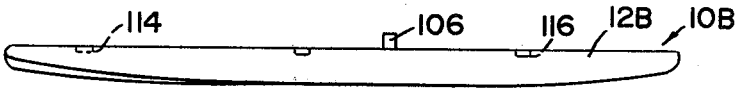
FIG. 11
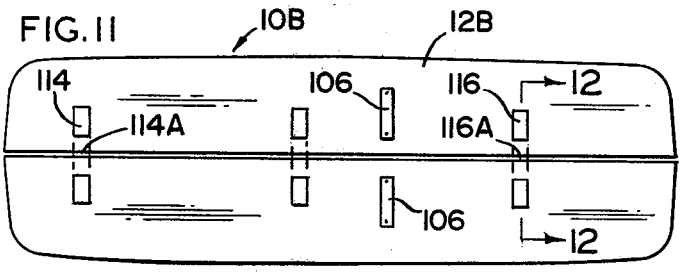
FIG. 16
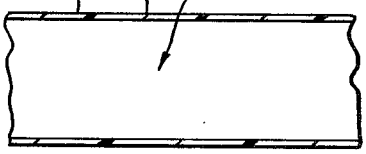
FIG. 17
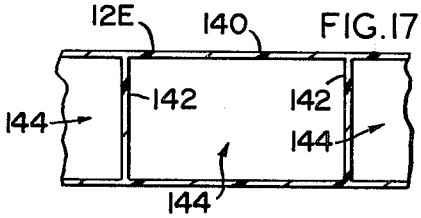
FIG. 13
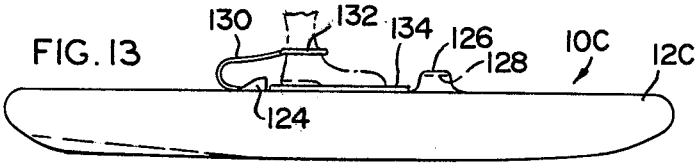
FIG. 18
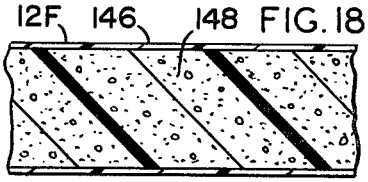
FIG. 14
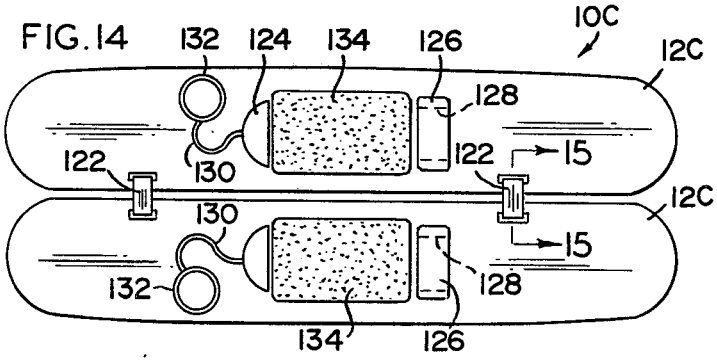
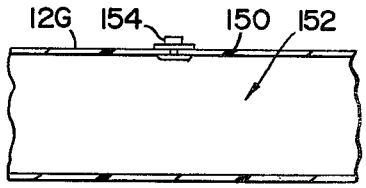
FIG. 19

AQUATIC DEVICE

CROSS-REFERENCE TO RELATED APPLICATIONS

This is a continuation-in-part of prior application Ser. No. 461,637 filed Apr. 17, 1974, now abandoned.

The foregoing abstract is merely a resume of one general application, is not a complete discussion of all principles of operation or applications, and is not to be construed as a limitation on the scope of the claimed subject matter.

BACKGROUND OF THE INVENTION

1. Field of the Invention

This invention relates to an aquatic device comprising a pair of pontoon-like elements each configured to accommodate and receive the operator's feet and a pair of paddles specifically configured for use in propelling the operator over a liquid such as water, while the operator is in either the standing or sitting position.

2. Description of the Prior Art

A number of prior art devices are presently known which are primarily designed to support the human body in water. Generally, these devices can be segregated into categories which include swimming aids, recreational devices such as rafts or small, single occupant propulsion devices such as floats.

The swimming aid and recreational type float devices are usually inflatable or alternately made of buoyant, lightweight material. Both of these types of devices, however, suffer from the problem of being relatively flimsy and generally inefficient in operation. In addition, these conventional devices are generally intended for limited use and are more often particularly designed to maintain the body afloat rather than increase the efficiency in traveling through water.

Since modern day society has provided more free, recreational time to the average individual, various apparati have been designed and made commercially available to aid in one's pleasure of this increased recreational activity. This is particularly true in the area of water sports. A primary concern, however, is providing these various apparati on a low cost basis while making available to the public, devices which are simple and efficient to operate and maintain at a reasonable cost. While all of these factors have generally been kept in mind, conventional recreational devices are still either generally inefficient due to the fact that they are being designed generally similar to prior art swimming aids and like floats or because they are overly complex. In the latter category, a number of said floats are available which generally resemble a single occupant type sailing boat. Because of the complexity in structure which is somewhat common to the vast majority of these prior art devices, their initial expense, trouble and cost of operation and maintenance and inefficiency of performance have rendered a large portion of these devices unattractive to the public at large.

Accordingly, it can be seen that there is a need for a recreational and commercial device readily adaptable for rescue efforts, recreational or other activities on a liquid such as water. Such a device should be initially inexpensive to obtain and manufacture and simple to operate and maintain by the user of such a device.

Therefore it is an object of this invention to provide an apparatus which overcomes the aforementioned inadequacies of the prior art devices and provides an improvement which is a significant contribution to the advancement of the pertinent art.

SUMMARY OF THE INVENTION

This invention relates to an aquatic device suitable for industrial and recreational uses as well as rescue efforts. More specifically, the device comprises a pair of flotation means each configured as a pontoon-like element to support the operator on a liquid, such as water, and a pair of paddles specifically configured for use with the pontoon-like elements.

Each flotation means comprises an elongated hull including an outer shell of suitable material and an inner body of suitable reinforceable material. A footwell may be formed on the upper surface of each flotation element to receive and support the operator's feet. A skid, formed on the center line of the outer shell, extends substantially the length of the elongated hull to enhance lateral stability. To provide additional stability, particularly in open water, a keel can be pivotably attached to the bottom of each outer shell essentially beneath the footwells. A keel housing is formed in the outer shell rearward of the footwells to receive the keels when not in use.

A flotation interconnecting means is provided to limit the relative movement between the flotation means. The interconnecting means may comprise a first and second interconnecting member attached to the side of each hull. The first and second interconnecting members each include coupling means at the outer end thereof to interconnect corresponding members. Since the interconnecting means is provided to prevent the flotation means from spreading too far apart, the length of the interconnecting members when interconnected, should be such that the operator's feet are separated to a comfortable distance. To enhance the use of the device, the interconnecting means further includes an adjustment means to change the effective length of the cables. To further enhance the stability, each first and second cable means may comprise an upper and lower interconnecting element attached separately to the outer shell at one end and interconnected by a bias means such as a spring or the like at the opposite end. Not only does this configuration increase stability, but also the bias means acts as a shock absorber to minimize stress on the cables and sides of the flotation means.

Attached to the rear portion of each flotation means can be variable directional control means comprising a rudder, substantially horizontal interconnecting bar and attachment means. The rudder is pivotally attached to the rear of the outer shell. Each attachment means comprises a braclet-like member configured to be attached to the operator's ankles. The interconnecting bar extends fore and aft to operatively interconnect the rudder and attachment means. The attachment means are constructed of flexible material to facilitate escape therefrom, if necessary.

A seat may be provided to permit the operator to rest or otherwise maneuver the device while seated. The seat comprises a support member which extends across both flotation means when in use and attached to the sides of one of the flotation means when not in use.

As previously mentioned, the paddles are specifically configured for simultaneous use of both by the operator. Each paddle comprises an elongated shaft having a blade formed at the lower end thereof and an upper arm engaging rest formed at the upper end thereof. The upper arm engaging rest is formed at a right angle to the longitudinal axis of the shaft as a movement means to act against the pressure exerted on the blade as it is passed through a liquid such as water.

Normally the aquatic device is operated with the operator in the standing position. To maintain balance, the operator can distribute his weight on both feet. To propel himself through the water, the operator attaches the paddles to his arms and moves the blades through the liquid such as water, in a motion similar to that used with a standard oar. The paddles may also be used for directional control.

To provide added stability, the first and second interconnecting members should be coupled together to limit the separation of the flotation means relative to each other. Alternate keels may be extended downward to the operating position. Of course, both the keels and interconnecting means may be used simultaneously.

As previously described, the operator may maneuver the device from a sitting position by repositioning the seat member between the flotation means.

This invention accordingly comprises an apparatus possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective view of the aquatic device in use.

FIG. 2 is a top view of the aquatic device.

FIG. 3 is a partial cross-sectional side view of the aquatic device.

FIG. 4 is a cross-sectional front view of the aquatic device taken along line 4—4 of FIG. 3.

FIG. 5 is a cross-sectional front view of the aquatic device taken along line 5—5 of FIG. 1.

FIG. 6 is a partial detailed view of a paddle.

FIG. 6A is a variation of the paddle shown in FIG. 6.

FIG. 7 is a side elevational view of a modification of the invention shown in FIGS. 1–6.

FIG. 8 is a front elevational view of the invention shown in FIG. 7.

FIG. 9 is a top elevational view of the invention shown in FIGS. 7 and 8.

FIG. 10 is a side elevational view of a second modification of the invention shown in FIGS. 1–9.

FIG. 11 is a top elevational view of the invention shown in FIG. 10.

FIG. 12 is a sectional view along line 12—12 of FIG. 11.

FIG. 12A is a variation of the invention shown in FIG. 12.

FIG. 13 is a side elevational view of still another variation of the invention shown in FIGS. 1–12.

FIG. 14 is a top elevational view of the invention shown in FIG. 13.

FIG. 15 is a sectional view along line 15—15 in FIG. 14, and

FIGS. 16–19 show partial sectional views of variations of the internal structure of the flotation means shown in FIGS. 1–15.

Similar reference characters refer to similar parts throughout the several views of the drawings.

DETAILED DESCRIPTION OF THE PREFERRED EMBODIMENT

As best shown in FIGS. 1 and 2, the present invention comprises an aquatic device generally indicated as 10. As shown therein, the aquatic device 10 includes a pair of flotation means each individually indicated as 12 and a pair of paddles each individually indicated as 14.

As best shown in FIGS. 2 and 3, each flotation means 12 is configured as a pontoon-like element 16 configured to cooperatively support the operator on the water. Each pontoon-like element 16 comprises an elongated hull including an outer shell 18 of suitable material and an inner body 20 of suitable bouyant material (FIG. 3). As best shown in FIG. 2, the outer shell 18 is contoured both at the leading edge and trailing edge 22 and 24 respectively, to substantially a point to facilitate movement of the device 10 through the water. However, the shape of the outer shell 18 is not limited to that specifically disclosed herein. For instance, a short, wide shape tends to maneuver well, while a longer, narrower shape tends to be less maneuverable, but is faster.

As best shown in FIGS. 3–5, a footwell 26 is formed in the upper surface of the outer shell 18 to receive the operator's feet. The bottom 28 of the footwell 26 is normally located below the center of gravity of each flotation means 12. The footwell 26 is dimensioned to permit the operator to move his feet fore, aft and laterally therein as more fully discussed hereinafter. As best shown in FIGS. 4 and 5, the sidewalls 30 of the footwell 26 are sloped inwardly to enable the operator to maintain a more natural posture. To enhance comfort and reduce fatigue, a pad or the like (not shown) may be disposed on the bottom 28.

As best shown in FIG. 5, a pair of substantially parallel skids 32 are formed along the center line of the outer shell 18. Each skid 32 extends substantially the length of the outer shell 18 and provide limited stability. Of course, a single skid 32 may be employed as shown in FIGS. 3 and 4.

To provide additional stability, particularly in open water, the device 10 may further include a keel means generally indicated as 34, as best shown in FIG. 3. The keel means 34 includes keel 36 pivotally attached to the outer shell 18 by hinge 38 with a keel housing 40 formed in the outer shell 18 rearward of the footwell 26 to receive the keel 36 when not in use. The position of the keel 36 relative to the outer shell 18 is controlled by keel positioning means generally indicated as 42. The keel positioning means 42 comprises a flexible interconnecting means 44 and attachment means 46. The flexible means 44, such as a cable extending through aperture 48, is attached to the keel 36 and attachment means 46 to permit adjustment by varying the length thereof.

As best shown in FIGS. 2 and 4, a flotation interconnecting means generally indicated as 50 is provided to limit the relative movement between the flotation means 12. As shown, a flotation interconnecting means 50 may be attached at the midportion of the flotation means. The flotation interconnecting means 50 comprises a first and second interconnecting member 52 and 54 respectively, attached to opposite flotation means 12 interconnected by coupling means 56. Since the interconnecting means 50 is provided to prevent the flotation means 12 from spreading too far apart, the effective length thereof can be such that the operator's feet are separated to a comfortable distance. To enhance use of the device 10, the interconnecting means 50 may include means to adjust the effective length thereof (not shown). As best shown in FIG. 4, the first and second interconnecting members 52 and 54 respectively, comprise upper and lower interconnecting elements 58 and 60 respectively, attached separately to the outer shell 18 at one end and attached to the coupling means 56 at the opposite end. Although elements 58 and 60 are shown as cables, any suitable interconnecting means may be used. Not only does this configuration increase stability, but also the interconnecting means 50 acts as a shock absorber to minimize stress on the sides of the flotation means 12.

As shown in FIG. 5, the first and second interconnecting members 52 and 54 may comprise single elements which are attached to the upper sidewalls of flotation means 12 to avoid entanglement with weeds and the like.

As best shown in FIGS. 2 and 3, attached to the rear portion of each flotation means 12 is a variable directional control means generally indicated as 62.

The directional control means 62 comprises a rudder 64, substantially horizontal interconnecting bar 66 and attachment means 68. The rudder 64 is pivotally attached to the rear of the outer shell by hinges 69. Each attachment means 68 comprises a braclet-like member configured to be attached to the operator's ankles. The interconnecting bar 66 comprises a first element 70 which extends fore and aft and a second element 72 coupled thereto to operatively interconnect the rudder 64 and attachment means 68. The first element 70 extends through guide means 74 to maintain the longitudinal position thereof. The attachment means 68 are constructed of flexible material to facilitate escape therefrom, if necessary.

As best shown in FIG. 3, a seat 76 may be provided to permit the operator to rest or otherwise maneuver the device 10 while seated. The seat 76 comprises a support member 78 pivotally attached to one flotation means 12 by attachment means 80. Support member 78 extends across both flotation means 12 when in use by attachment to attachment means 82. The support member 78 is attached to the sides of one of the flotation means 12 by attachment means 84 when not in use.

The paddles 14 are specifically configured for simultaneous use of both arms of the operator. As shown in FIG. 6, each paddle 14 comprises an elongated shaft 85 having a blade 86 formed at the lower end thereof and an upper arm engaging rest 88 formed at the upper end thereof. The upper arm engaging rest 88 is formed at a right angle to the longitudinal axis of the shaft 85 as a movement means to act against the pressure exerted on the blade as it is passed through the water. The upper arm engaging rest 88 comprises a first and second rest member 90 and 92 respectively, to cooperatively form the arm support. A fastening means comprising a flexible element 94 with apertures 96 formed therein and attachment elements 98 formed on the first rest member 90 which cooperate to fasten the paddle 14 to the operator's arm.

FIG. 6A shows a modification of FIG. 6 wherein the paddle 14A includes an elongated shaft 85A. An upper arm engaging rest 88A has an internal aperture for frictionally receiving the elongated shaft 85A to locate the rest member 90A relative to the shaft 85A. The rest 88A may be removed from the shaft 85A to enable the paddle 14A to be collapsed for transportation. In addition, the rest 88A may be mounted on shaft 85A with the rest member 90A being inverted relative to the position shown in FIG. 6A.

Normally, the aquatic device 10 is operated with the operator in the standing position. To operate, the operator can place his feet in the footwells 26. To maintain balance, the operator can distribute his weight equally on both feet. To propel himself through the water, the operator may attach the paddles 14 to his arms and move the blades 86 through the water in a motion similar to that used with a standard oar. To change direction, the operator may move his feet fore and aft in the footwells 26 causing the rudders 64 to move as previously described. To provide a coordinated turn, both feet can be moved in the same direction. Of course, the paddles 14 may be used to control the direction of travel.

To provide additional stability, the first and second interconnecting means 52 and 54 should be coupled together by coupling means 56 to limit the separation of the flotation means 12 relative to each other. Alternately, keels 36 may be extended downward to the operating position. Of course, both the keels 36 and interconnecting means 52 and 54 may be used simultaneously.

As previously described, the operator may maneuver the device from a sitting position by repositioning the seat member 78 between the flotation means 12.

FIGS. 7–9 illustrate a variation of the invention shown in FIGS. 1–6. In this embodiment, the device 10A comprises a plurality of flotation means 12A having footwells 26A and keel means 34A. The flotation means 12A are similar to the flotation means 12 shown in FIGS. 1–5, but exhibit a slightly different configuration. In this embodiment, a connecting plate 100 having plural studs 102 are insertable in apertures 104 of each of the flotation means 12A. The plate 100 unifies the structure into a rigid vessel with the plural flotation means 12A displaced relative to one another. The plate includes toe straps 106 for receiving the operator's feet 108 as shown in FIGS. 7 and 9. It should be noted that the addition of the connecting plate 100 eliminates the need for the flotation interconnecting means 50 shown in FIGS. 1–5. Apertures 110 may be provided in the connecting plate 100 for enabling access to footwells 26A. In addition, a small motor or sail may be affixed to a region 112 of the connecting plate 100.

FIGS. 10–12A represent a device 10B which is a second variation of the instant invention. The device 10B includes flotation means 12B having elastic bands 114 and 116 for securing the flotation means 12B relative to one another. Toe straps 106 aid in securing the operator's feet (not shown) to the flotation means 12B. It should be appreciated from this embodiment that the device 10B may be fashioned from a rigid upper surface such as hard plastic or metal with a solid inner supporting material such as foam or the like.

FIG. 12 illustrates the elastic band 116 secured at terminal ends 118 and established through a tunnel 120 internal the flotation means 12B. The elastic band 114 is of similar fabrication. This arrangement enables the flotation means 12B to be folded as a book about elastic band portions 114A and 116A.

FIG. 12A illustrates a variation of the elastic band 116 which is established on the upper surface of the flotation means 12B.

FIGS. 13–15 illustrate a device 10C which is still a third variation of the instant invention. In this embodiment, plural flotation devices 12C are secured together by elastic endless loops 122 extending about portions of each of the flotation means 12C. Each of the flotation means 12C includes a heel stop 124 and a toe ring 126 having an aperture 128 for receiving the toe portion of an operator (not shown). An ankle tie comprising a flexible connector 130 and an ankle ring 132 secures the flotation devices 12C to the operator's feet. Abrasive pads 134 prevent slipping of the operator's feet when the operator elects to stand on the flotation devices 12C without the use of the toe rings 126.

FIGS. 16–19 illustrate various cross-sectional views of flotation means 12D–12G compatible for use in the aforementioned embodiments shown in FIGS. 1–15. FIG. 16 illustrates a flotation device 12D having a substantially rigid wall 136 and a substantially hollow internal chamber 138. FIG. 17 shows an alternate embodiment of the flotation means 12E having a substantially rigid wall 140 with internal supports 142 dividing the internal structure of the flotation means into hollow chambers 144.

FIG. 18 illustrates another embodiment of flotation means 12F including a substantially rigid wall 146 having a foam material 148 occupying substantially all of the internal volume of the flotation means 12F. FIG. 19 illustrates another embodiment of a flotation means 12G having a flexible wall 150 for receiving pressure in the hollow interior portion 152 through a pneumatic valve 154. It should be apparent that any of the cross-sections shown in FIGS. 16–19 may be incorporated within the invention shown in FIGS. 1–5 and 7–15.

The present disclosures includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An aquatic device comprising in combination:

a pair of flotation means for supporting the legs of an operator on a liquid such as water;

each of said flotation means comprising an outer shell for receiving the feet of the operator;

flotation interconnection means including a coupling for interconnecting the pair of flotation means to control the separation between said flotation means;

said coupling means comprising a resilient coupling element;

a pair of paddles specifically configured for use in combination with the floats;

each of said paddles comprising an elongated substantially tubular shaft having a blade formed at one end of said shaft;

an upper arm engaging rest rigidly extending in substantially perpendicular relationship to the longitudinal axis of the elongated shaft and disposed at the opposite ends of the elongated shafts relative to said paddles;

an arm support mounted at the terminal end of each of said arm engaging rest and disposed to be remote relative to the elongated shafts;

said arm supports being partially circular for receiving the lower arm region of the operator while the operator grasps the elongated shafts adjacent the juncture of the upper arm engage rest and the elongated shaft thereby forming a triangle between said arm support and said tubular shaft and the lower arm region of the operator; and said arm supports being removably mounted to said tubular shafts enabling said arm supports to be positioned to either contact the upper or lower side of the lower arm region of the operator.

2. The aquatic device of claim 1 wherein each of said flotation means comprises a pontoon-like element.

3. The aquatic device of claim 1 further including a keel means comprising a keel pivotally attached to said outer shell, a keel housing formed in the bottom of said outer shell, and attachment means mounted on said outer shell, said attachment means and said keel interconnected by connecting means to control the position of said keel relative to said keel housing.

4. The aquatic device of claim 1 wherein said outer shell includes at least one skid formed along the longitudinal length thereof.

5. The aquatic device of claim 1 further including a directional control means, said directional control means comprising a rudder pivotally attached to said outer shell, an attachment means configured to operatively engage the lower portion of the operator's leg and interconnecting means interconnecting said attachment means and said rudder means.

6. The aquatic device of claim 5 wherein said interconnecting means comprises a substantially horizontal bar extending along the longitudinal axis of said outer shell.

7. The aquatic device of claim 1 wherein each of said outer shells have footwells to receive each of the operator's feet with sidewalls of said footwells being inclined inwardly relative to said outer shell.

8. The aquatic device of claim 1 further including a seat means which is movably mounted on one of said flotation means, said seat means movable between a first and second position, said seat means being substantially parallel to the longitudinal axis of said one flotation means and interconnecting said pair of flotation means when in said second position.

9. An aquatic device of claim 1 including a connector plate securable to each of said pair of flotation means for providing a substantially rigid structure.

10. An aquatic device of claim 1 including abrasive means formed on each of said flotation means for receiving each of the operator's feet.

11. An aquatic device of claim 1 wherein said flotation means comprises a substantially rigid outer shell and a substantially hollow inner portion.

12. An aquatic device of claim 1 wherein said flotation means comprises a substantially rigid outer shell with foam means occupying substantially the inner portion of said outer shell.

13. An aquatic device of claim 1 wherein said flotation means comprises a substantially flexible outer shell and pneumatic valve means for enabling the internal portion of said outer shell to be pressurized.

14. An aquatic device of claim 1 including means for securing each of said pair of flotation means to each of the operator's legs.

* * * * *